US007854082B2

(12) United States Patent
De Gregorio

(10) Patent No.: US 7,854,082 B2
(45) Date of Patent: Dec. 21, 2010

(54) DEVICE FOR OPENING AND CLOSING ROLLING BLOCK FIREARMS

(75) Inventor: Vito De Gregorio, Bologna (IT)

(73) Assignee: Fabbrica d'Armi Pietro Beretta - S.p.A., Gardone Val Trompia (IT)

( * ) Notice: Subject to any disclaimer, the term of this patent is extended or adjusted under 35 U.S.C. 154(b) by 921 days.

(21) Appl. No.: 11/665,299

(22) PCT Filed: Apr. 25, 2005

(86) PCT No.: PCT/IB2005/001177

§ 371 (c)(1),
(2), (4) Date: Apr. 13, 2007

(87) PCT Pub. No.: WO2006/046094

PCT Pub. Date: May 4, 2006

(65) Prior Publication Data

US 2007/0266608 A1 Nov. 22, 2007

(30) Foreign Application Priority Data

Oct. 25, 2004 (IT) ..... BO2004A0663

(51) Int. Cl.
*F41A 3/04* (2006.01)

(52) U.S. Cl. ..... 42/44

(58) Field of Classification Search ..... 42/40, 42/44

See application file for complete search history.

(56) References Cited

U.S. PATENT DOCUMENTS

| | | | |
|---|---|---|---|
| 2,095,297 | A | 10/1937 | Stiennon |
| 2,683,947 | A | 7/1954 | Holt |
| 3,636,646 | A | 1/1972 | Drevet |
| 5,111,607 | A | 5/1992 | Blaser et al. |

FOREIGN PATENT DOCUMENTS

| | | | |
|---|---|---|---|
| BE | 900 065 | A1 | 1/1985 |
| DE | 27 44 402 | A1 | 4/1979 |
| GB | 1 556 732 | A | 11/1979 |

*Primary Examiner*—Troy Chambers
(74) *Attorney, Agent, or Firm*—Modiano & Associati; Albert Josif; Daniel J. O'Byrne

(57) ABSTRACT

An opening and closing device, associated with the rolling block and receiver of a hunting or sports gun, comprises a key that is hinged by a tube to the upper part of the rolling block, and a bolt that is actuated by a shaped end of the key and is slidably mounted on the rolling block in such a way that it can be moved from a retracted, open position in which the bolt is entirely inside the rolling block, and an advanced, closed position in which the bolt protrudes from the front of the rolling block with two arms designed to lock by friction two matching mortises made in the receiver; the arms extend from the ends of a shoulder of the bolt and the shaped end of the key has a first cam designed to exert a pushing action to the central portion of the shoulder in order to disengage the arms from the mortises.

16 Claims, 5 Drawing Sheets

DEVICE FOR OPENING AND CLOSING ROLLING BLOCK FIREARMS

TECHNICAL FIELD

The present invention relates to a device for opening and closing rolling block firearms.

In the sector of portable firearms, a rolling block firearm is one in which a receiver that supports the barrel (or barrels) is hinged to a central block, called rolling block, that houses the firing mechanisms. Reciprocal rotation of the receiver and the rolling block makes it possible to open the firearm so that it can be manually loaded.

This specification refers in particular, but without restricting the scope of the invention, to rolling block shoulder firearms, especially hunting and sports guns which, as is known, have an opening and closing device comprising a bolt operated by a key located at the top of the rolling block.

BACKGROUND ART

In a known type of rolling block firearm, the bolt is housed in the rolling block and has two tenons which project from the front of the block and which, when the block is closed, fit snugly into two mortises made in the receiver that supports the barrel (or barrels).

Turning the key towards the open position makes the bolt slide back towards the gun stock, thus disengaging the tenons from the mortises and causing them to move back into the rolling block.

The coupling between the key and the bolt is made by an eccentric tooth that fits into a socket made in one side of the bolt. This type of coupling requires of the gun user a relatively high critical release moment to overcome the friction between receiver and bolt when the latter is in the closed position.

To obtain an acceptable value for the critical release moment, firearm manufacturers, when designing a firearm, tend to reduce the overall coupling surface between mortises and tenons. This, however, causes unwanted slipping between the receiver and the bolt every time a shot is fired. This slipping causes wear on the mortises and tenons which, in the long run, leads to slack and vibrations. To compensate for the wear, the two tenons are made longer so that, when a gun is new, they do not enter the mortises completely and go in further and further over time, as they gradually wear.

Obviously, wear compensation of this type is possible until such time as the tenons go into the mortises as far as possible. Once this limit has been reached, the gun requires maintenance which is very expensive.

In addition to this drawback, compensation for wear as just described causes the closing position of the key to drift, eventually leading to its misalignment with respect to the line of sight and disturbing the shooter's aim. To avoid this, shoulder firearms are normally manufactured in such a way that the key in a new gun is shifted to the right of the line of sight and tends to come into line with it as the tenons and mortises wear.

The present invention has for an object to provide a device for opening and closing rolling block firearms that overcomes the above mentioned drawbacks.

According to the invention, this object is achieved by a device for opening and closing rolling block firearms having the characteristics described in claim 1.

The claims dependent on claim 1 refer to advantageous preferred embodiments of the invention.

BRIEF DESCRIPTION OF THE DRAWINGS

A preferred, non-restricting embodiment of the invention provided purely by way of example is described below with reference to the accompanying drawings, in which.

DETAILED DESCRIPTION OF THE PREFERRED EMBODIMENTS OF THE INVENTION

Figure 1:
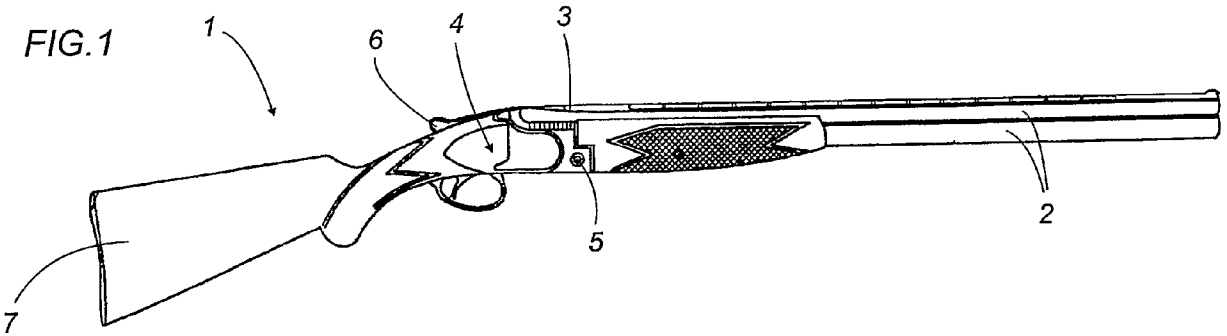
FIG. 1 shows a hammerless, over and under hunting gun comprising an opening and closing device according to the present invention.

The reference numeral 1 in FIG. 1 denotes in its entirety a hammerless hunting gun with over and under barrels 2.

The barrels 2 are rigidly mounted on a receiver 3, which is hinged to a central unit, known as rolling block 4, of the gun 1 by means of a pin 5.

Figure 6:
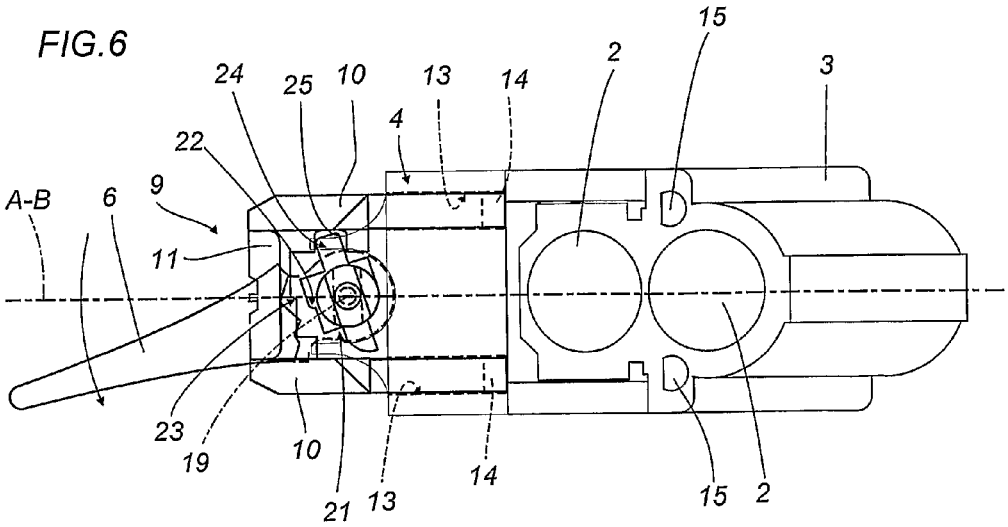

The pin 5, once the gun 1 is unlocked using a lever of an opening key 6 located on the upper part of the rolling block 4, allows the receiver 3 and the barrels 2 to be turned with respect to the rolling block 4. Thus, when the gun is open, the position of the barrels 2 is such that cartridge cases can be removed and new cartridges loaded (FIG. 6).

The receiver 3 may be attached to the barrels 2 in various ways: for example, it may be fastened mechanically or welded or it may be made as a single piece with the barrels.

On the side opposite the receiver 3, the rolling block 4, which houses the firing mechanism, which is not described in detail here since it is of well known type, rigidly supports a gunstock 7 with a frame 8.

As shown in FIGS. 2 to 6, the key 6 forms part of a device 9 used to open and close the gun 1 and comprising a bolt 10 actuated by the key 6 and housed inside the rolling block 4 just under the latter's upper part.

Figure 7:
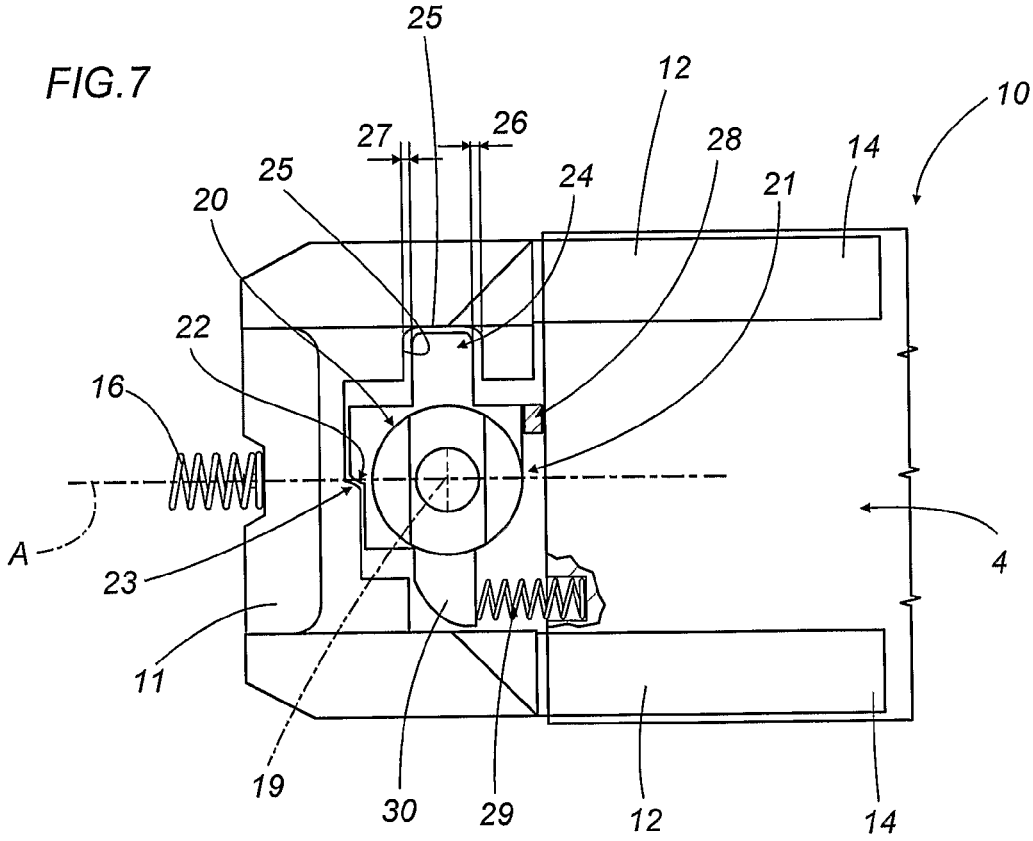
FIG. 7 is a scaled-up view of a detail from FIG. 4.

The bolt 10, shown in detail in FIG. 7, is U-shaped and has two arms 12 positioned symmetrically about a central plane A of the bolt 10 itself and extending perpendicularly, and on the same side, from the two ends of a shoulder 11.

The shoulder 11 of the bolt 10 faces the gunstock 7, whilst the arms 12 extend towards the barrels 2 in a direction parallel with the barrels 2, with the plane A coinciding with a plane B of substantial longitudinal symmetry of the gun 1.

Figure 2:
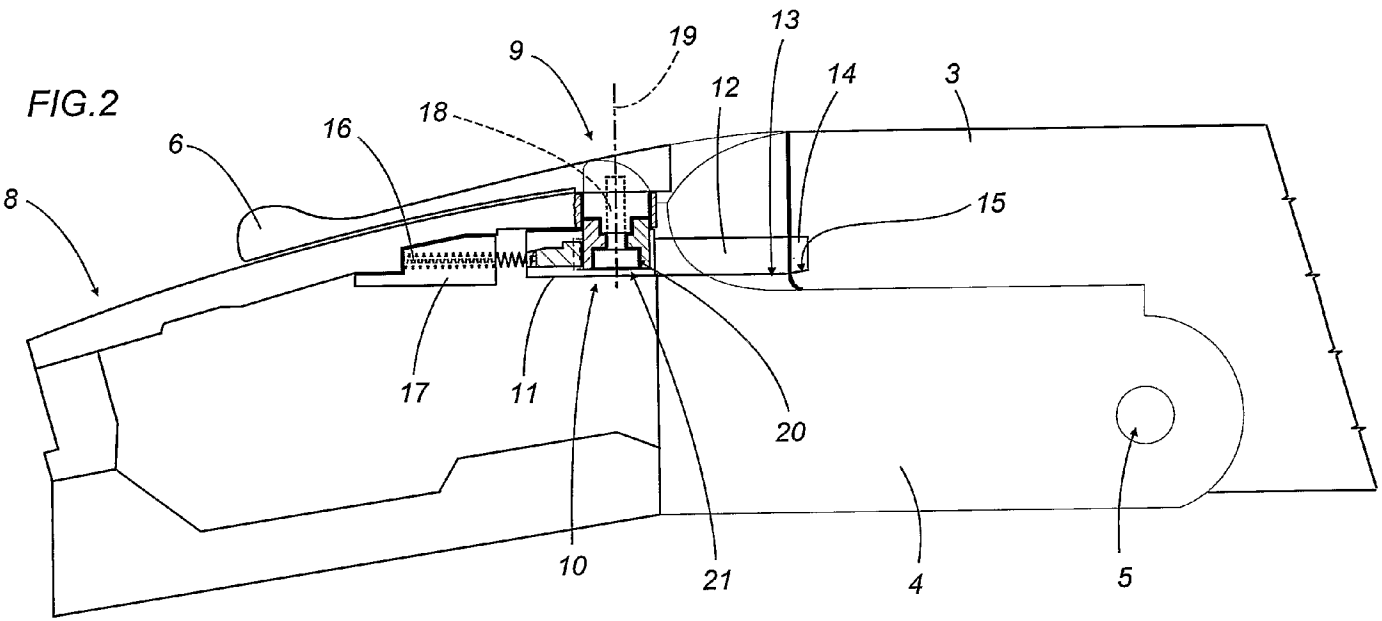
FIG. 2 shows a detail of the gun of FIG. 1, with some parts in cross section and others cut away.
Figure 3:
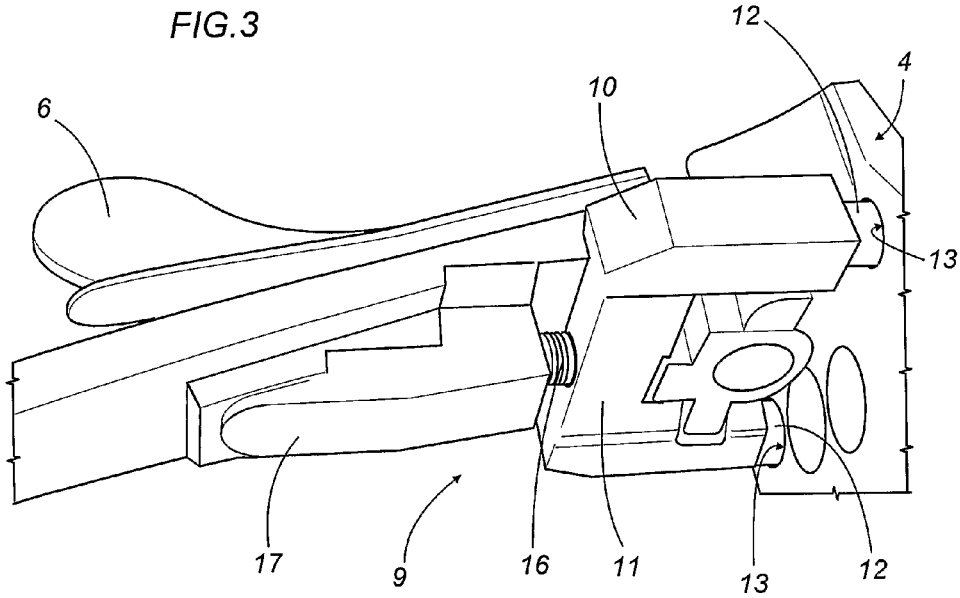
FIG. 3 is a perspective view of the detail of FIG. 2.
Figure 4:
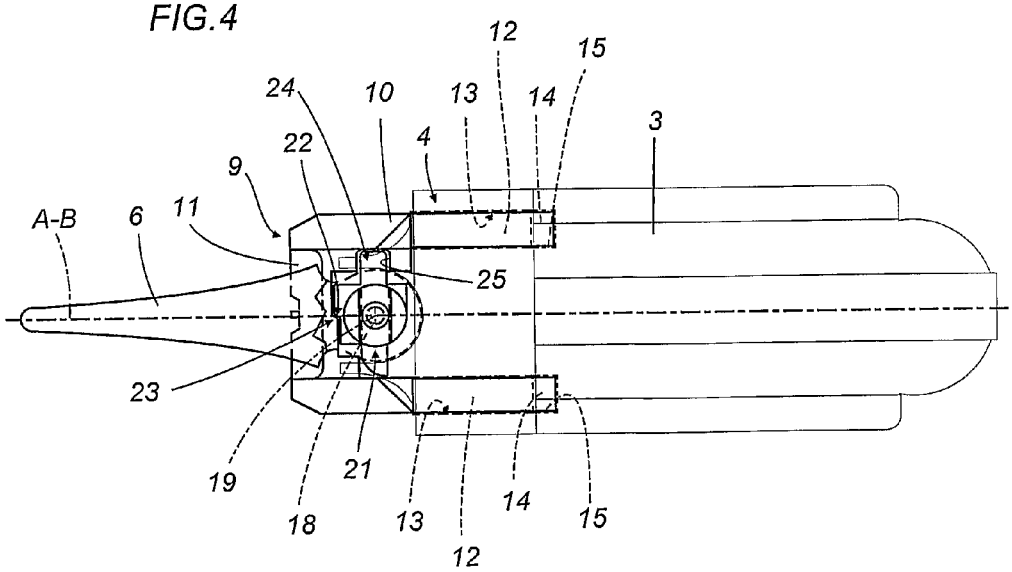
FIGS. 4 to 6 illustrate three positions of the opening and closing device according to the present invention.
Figure 8:
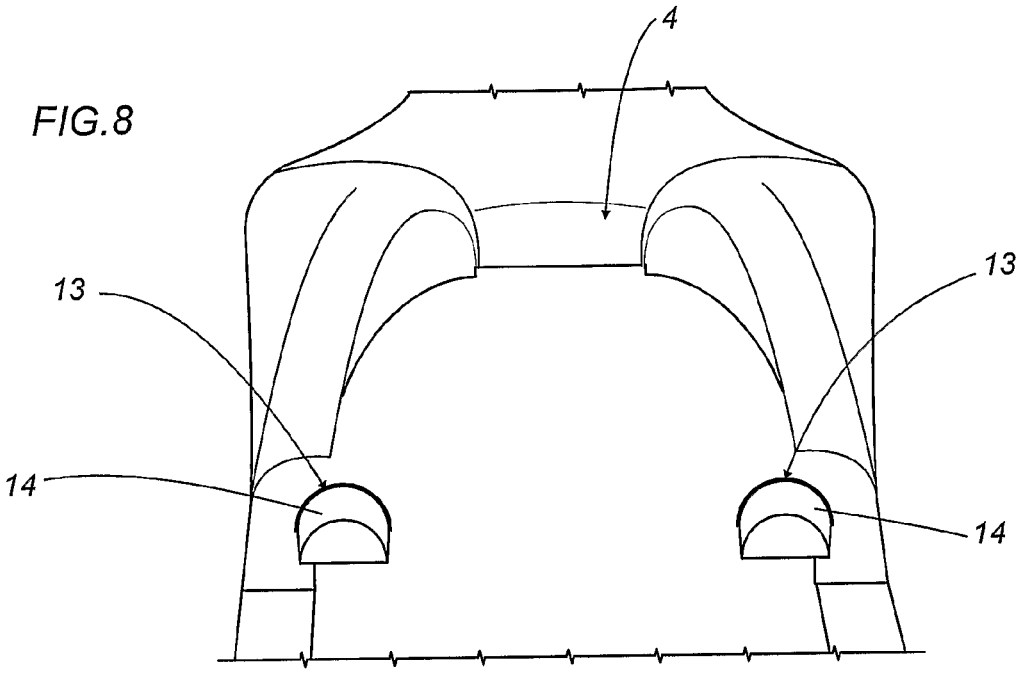
FIG. 8 is a perspective view of another detail of the gun of FIG. 1.

The bolt 10 is slidably coupled with the rolling block 4 and, more specifically, its arms 12 are inserted in respective through holes 13 in the rolling block 4 and protrude from the front of the block to form two respective tenons 14 when the bolt 10 is in the closed position (FIGS. 2, 4, 8).

In the advanced, closed position, the tenons 14 are inserted fully home into, and fit snugly in, two matching mortises 15 made in the receiver 3 outside the shank of the upper barrel 2, whilst in the retracted, open position (FIG. 6) the tenons 14 are housed entirely inside the holes 13.

The bolt 10 is locked in the closed position by elastic means, consisting in this particular instance of a helical spring 16 of the device 9 (FIGS. 2, 3, 7) that presses against the shoulder 11 on the side opposite the arms 12 and is positioned between the shoulder 11 and an abutment 17 forming part of the rolling block 4 and fixed under the latter's upper part.

When a shot is fired, the spring 16 allows the bolt 10 to slide back relative to the rolling block 4 and then to follow the movement of the receiver 3, without letting the tenons 14 and mortises 15 slip, thereby avoiding the damage that such slipping would cause.

Figure 5:
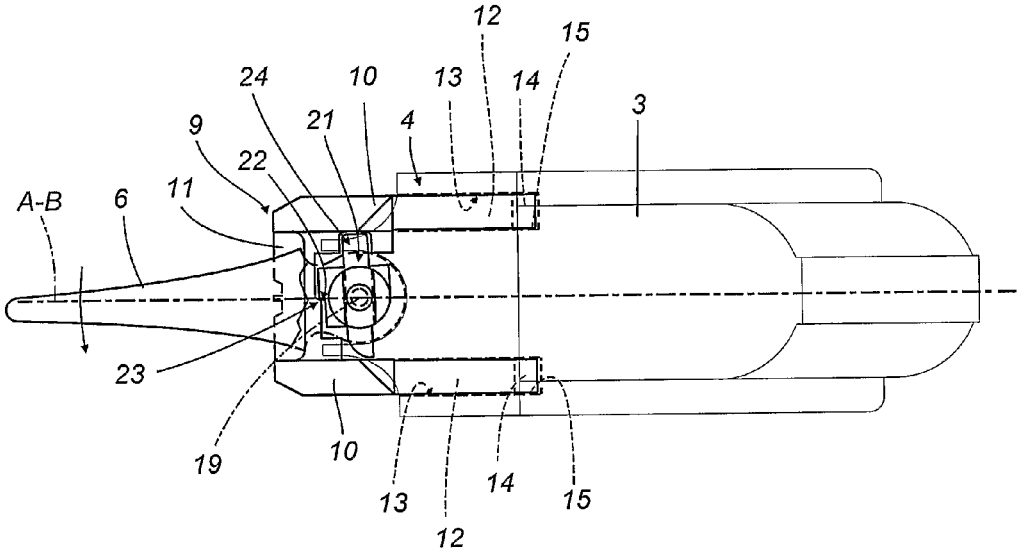

The bolt 10 can be retracted to the open position by manually pulling the lever of the key 6 to overcome the opposing action of the spring 16. FIG. 4 shows the key 6 in the closed position, with the lever perfectly aligned with the line of sight, whilst FIGS. 5 and 6 show the key 6 in an intermediate open position and in a fully open position, respectively. As may be inferred from FIGS. 4, 5 and 6, the bolt 10 is opened by turning the key 6 to the right of the line of sight, that is to say, by turning the key 6 anticlockwise in FIGS. 4, 5 and 6.

As can be seen better in FIG. 2, the key 6 is hinged to the rolling block 4 by a tube 18 allowing it to rotate about an axis 19 orthogonal to the plane in which the bolt 10 lies and lying in the plane A.

The end of the tube 18 positioned inside the rolling block 4 close to the bolt 10 is pressure fitted in a central socket 20 in a wheel 21.

The wheel 21 is positioned in the same plane as the bolt 10, between the two arms 12 and against the shoulder 11, and is peripherally equipped with a first cam 22 designed to act in conjunction with a central protrusion 23 on the shoulder 11 to impart to the bolt 10 a first translational movement towards the gunstock 7.

The wheel 21 also has a second cam 24 designed to act in conjunction with a hollow 25 in the arm 12 on the left-hand side of the line of sight to impart to the bolt 10 a second translational movement towards the gunstock 7.

The wheel 21 may be attached to the tube 18 not only by pressure fitting but also in various other ways: for example, it may be made as a single piece with the tube. Whatever the case, the wheel 21, with its two cams 22 and 24, constitutes one end of the shaped key 6 to drive the bolt 10.

The first cam 22, the second cam 24, the protrusion 23 and the hollow 25 are positioned and shaped in such a way that, as the bolt 10 moves from the closed position to the open position, first the protrusion 23 is engaged by the first cam 22 and then the hollow 25 is engaged by the second cam 24.

In the positions illustrated in FIGS. 4 and 7, where the key 6 is in the closed position, the cams 22 and 24 are separated by a small gap from the protrusion 23 and from the hollow 25, respectively. The bolt 10 is therefore disengaged from the key 6 and held against the mortises 15 of the receiver 3 by the spring 16.

When the key 6 lever is turned a little way to the right (FIG. 5) the cam 22 comes into contact with the protrusion 23 and pushes it towards the gunstock 7, thus causing the bolt 10 to move back a little. At this stage, in which the cam 24 remains separated from the hollow 25, the disengagement force F1 applied centrally to the bolt 10 by the shooter using the key 6—wheel 21 assembly overcomes the friction between the tenons 14 and the mortises 15, as well as the opposing force of the spring 16, thereby disengaging the bolt 10 and the receiver 3.

The cam 22 and the respective protrusion 23 thus constitute means for disengaging the bolt 10.

Turning the key 6 lever further to the right (FIG. 6) brings the cam 24 into contact with the hollow 25, thereby moving the bolt 10 all the way back. At this stage, the sideways driving force F2 applied to the bolt 10 by the shooter using the key 6—wheel 21 assembly again overcomes the opposing force of the spring 16.

As may be inferred from the above description, the forces F1 and F2 are both relatively moderate. In particular, the disengagement force F1 is relatively low compared to the size of the contact surfaces between tenons 14 and mortises 15 since it acts centrally on the bolt 10.

It should be noticed, with reference to FIG. 7, that between the hollow 25 and the respective cam 24 there is a certain amount of clearance, defined by the gaps 26 and 27 which not only enable the bolt 10 to be positioned in the fully closed position without acting on the key 6, but also allows the bolt 10 itself to be disengaged during the initial rotation of the key by a just a few degrees. Indeed, during the initial rotation, only the cam 22 and the protrusion 23 come into contact since the cam 24 moves in the gap 27 without coming into contact with the respective wall of the hollow 25.

The gap 26 allows the key 6 to move to the end of its stroke (zero position) without acting on the bolt 10.

The end-of-stroke position is defined by a limit block 28, whilst a spring 29 acting between an arm 30, extending from the wheel 21 diametrically opposite the cam 24, and the rolling block 4 enables the key 6 to move to its zero position.

It should be noticed that when the cam 22 comes into contact with the protrusion 23, the disengagement force F1 applied centrally to the bolt 10 presents a first vector component F1*u* in the direction of the line of sight and oriented towards the gunstock 7, and a second vector component F1*t*, orthogonal to the line of sight and oriented towards the arm 12 on the right of the line of sight. The vector component F1*u* imparts to the bolt 10 the aforementioned backward translational movement towards the gunstock 7, whilst the vector component F1*t* constrains the bolt 10 transversely in unbalanced manner.

Figure 9:
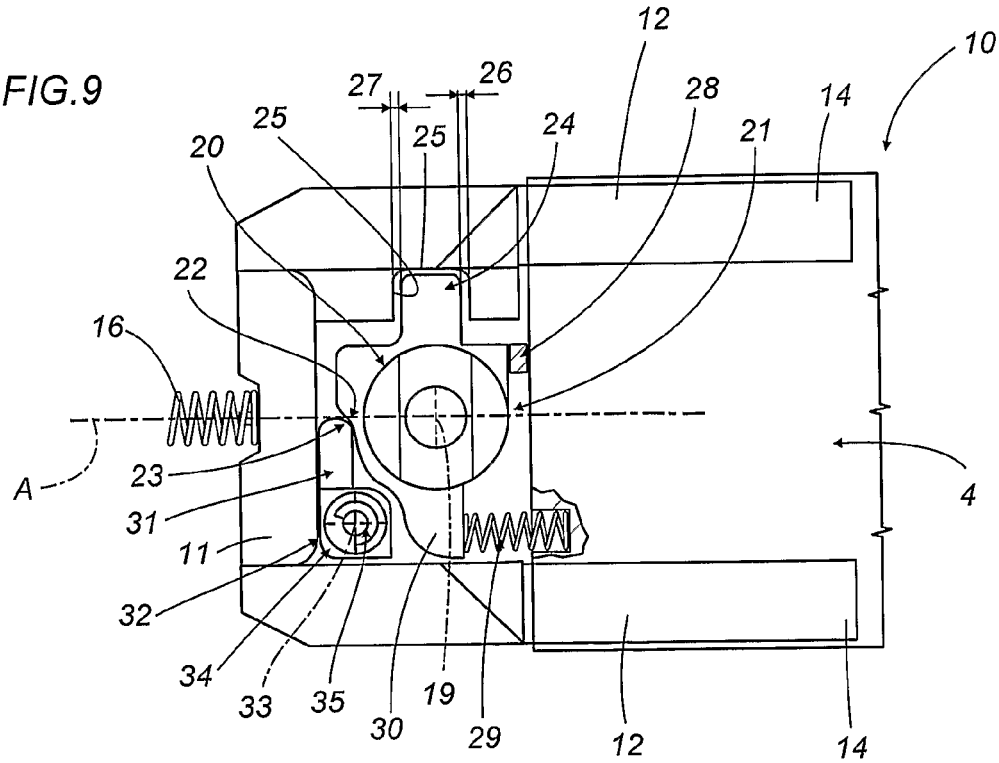
FIG. 9 shows another embodiment of the detail illustrated in FIG. 7.

FIG. 9 shows another embodiment of the opening and closing device 9 as described above but in which the shoulder 11 of the bolt 10 does not have the protrusion 23. In this embodiment, the protrusion 23 is substituted by the arm 31 of an L-shaped lever 32 hinged to the upper part of the rolling block 4 by a pin 35 so that it rotates about an axis 33 parallel to the aforementioned axis 19.

When the bolt 10 is in the advanced, closed position (FIG. 9), the lever 32 is housed in the vicinity of the corner of the bolt 10 between the shoulder 11 and the arm 12 on the right of the line of sight, with the arm 31 facing the shoulder 11 and the other arm 34, which is coupled with the pin 35, facing the arm 12. In this position the arms 31 and 34 are separated from the shoulder 11 and from the arm 12, respectively.

When the key 6 lever is turned a little way towards the open position of the bolt 10, the disengagement force F1 makes the lever 32 turn—in an anticlockwise direction in FIG. 9—and causes the bolt 10 to be pushed centrally back by the arm 31. In other words, the pushing action on the central portion of the shoulder 11 is applied by the cam 22 in this case too, but indirectly through the lever 32 which acts as a passive element.

Obviously, in this case, the vector component F1*u* is applied centrally to the shoulder 11 through the arm 31, whilst the vector component F1*t* is discharged directly on the rolling block 4 through the pin 35, preventing unwanted jamming and deformation of the bolt 10.

As in the first embodiment described above, the first cam 22, the second cam 24, the lever 32 and the hollow 25 are positioned and shaped in such a way that, as the bolt 10 moves from the advanced, closed position to the retracted, open position, first the arm 31 of the lever 32 is engaged by the first cam 22 and then, after the arm 31 has been pushed by the shoulder 11, the hollow 25 is engaged by the second cam 24.

The opening and closing device 9 as described above therefore:

- permits a secure end coupling between the receiver 3 and the rolling block 4, while allowing the shooter to open the gun 1 with relatively little effort;
- substantially eliminates slipping between the tenons 14 and the mortises 15;
- significantly reduces wear on the tenons 14 and the mortises 15;
- permits optimum positioning of the key 6 lever which, when the bolt 10 is in the advanced, closed position, is exactly aligned with the line of sight and does not drift from this position.

It will be understood that the invention as described above with reference to the gun 1 may also be applied to a generic rolling block firearm such as, for example, a hunting or sports gun with a single barrel, with side-by-side barrels (double gun) or with three barrels (drilling).

What is claimed is:

1. An opening and closing device for rolling block firearms comprising a rolling block, at least one barrel and a receiver, said receiver being attached to the barrel and hinged to the rolling block;

the device being associated with the rolling block and receiver so as to allow reciprocal rotation of the rolling block and of the receiver to open and reciprocal end locking between the rolling block and the receiver to close;

the device comprising a key that is hinged by a tube to the upper part of the rolling block, and a bolt that is actuated by a shaped end of the key and is slidably mounted on the rolling block in such a way that it can be moved from a rectracted, open position in which the bolt is entirely inside the rolling block, and an advanced, closed position in which the bolt protrudes from the front of the rolling block with two arms designed to lock by friction two matching mortises made in the receiver;

the arms extending from the ends of a shoulder of the bolt;

the shaped end of the key having a first cam designed to exert a pushing action on the central portion of the shoulder in order to disengage the arms from the mortises;

the first cam acting in conjuction with a central protrusion on the shoulder so as to disengage the arms from the mortises;

the shaped end of the key having a second cam designed to act in conjunction with a hollow in one of the arms in order to move the bolt to the retracted, open position; and the first and the second cam, the protrusion and the hollow being positioned and shaped in such a way that, as the bolt moves from the advanced, closed position to the retracted, open position, first the protrusion is engaged by the first cam and then the hollow is engaged by the second cam.

2. The device of claim 1, further comprising elastic means acting on the bolt in such a way as to keep the bolt in the advanced, closed position.

3. The device of claim 2, wherein the elastic means consist of a helical spring that presses against the shoulder of the bolt on the side opposite the arms and is positioned between the shoulder and an abutment forming part of the rolling block.

4. The device of claim 2, wherein the elastic means consist of a helical spring that presses against the shoulder of the bolt on the side opposite the arms and is positioned between the shoulder and an abutment forming part of the rolling block.

5. The device according to claim 2, further comprising a limit block that defines an end-of-stroke zero position of said key, and a spring acting between an arm of said key and said rolling block to allow said key to reach said zero position when said bolt is in said advanced closed position.

6. The device of claim 1, wherein the key has a manual actuating lever that is aligned with the line of sight when the bolt is in the advanced, closed position.

7. An opening and closing device according to claim 1, comprised in a rolling block firearm.

8. An opening and closing device for rolling block firearms comprising a rolling block, at least one barrel and a receiver, said receiver being attached to the barrel and hinged to the rolling block:

the device being associated with the rolling block and receiver so as to allow reiprocal rotation of the rolling block and of the receiver to open and reciprocal end locking between the rolling block and the receiver to close;

the device comprising a key that is hinged by a tube to the upper part of the rolling block, and a bolt that is actuated by a shaped end of the key and is slidably mounted on the rolling block in such a way that it can be moved from a rectracted, open position in bolt is entirely inside the rolling block and an advanced, closed position in which the bolt protrudes from the front of the rolling block with two arms designed to lack by friction two matching mortises made in the receiver;

the arms extending from the ends of a shoulder of the bolt;

the shaped end of the key having a first cam designed to exert a pushing action on the central portion of the shoulder in order to disengage the arms from the mortises;

the first cam acting in conjunction with a lever hinged to the rolling block so that the pushing action is exerted on the shoulder through the lever;

the shaped end of the key having a second cam designed to act in conjunction with a hollow in one of the arms in order to move the bolt to the retracted, open position; and the first and the second cam, the lever and the hollow being positioned and shaped in such a way that, as the bolt moves from the advanced, closed position to the retracted, open position, first the lever is engaged by the first cam and then the hollow is engaged by the second cam.

9. The device of claim 8, wherein the lever is L-shaped and has a first arm facing the shoulder and a second arm hinged to the rolling block and facing one of the arms; the pushing action on the central portion of the shoulder being exerted through the first arm.

10. The device of claim 8, wherein when the bolt is in the advanced, closed position, the lever is housed in the vicinity of the corner of the bolt between the shoulder and one of the arms.

11. An opening and closing device for rolling block firearms comprising a rolling block, at least one barrel and a receiver, said receiver being attached to the barrel and hinged to the rolling block;

the device being associated with the rolling block and receiver so as to allow reciprocal rotation of the rolling block and of the receiver to open and reciprocal end locking between the rolling block and the receiver to close;

the device comprising a key that is hinged by a tube to the upper part of the rolling block, and a bolt that is actuated by a shaped end of the key and is slidably mounted on the rolling block in such a way that it can be moved from a retracted, open position in which the bolt is entirely inside the rolling block, and an advanced, closed position in which the bolt protrudes from the front of the rolling block with two arms designed to lock by friction two matching mortises made in the receiver;

the arms extending from the ends of a shoulder of the bolt;

the shaped end of the key having a first cam designed to act in conjuction with a central protrusion of the shoulder in order to disengage the arms from the mortises;

the shaped end of the key having a second cam designed to act in conjunction with, a hollow in one of the arms in order to move the bolt to the retracted, open position; and the first and the second cam, the protrusion and the hollow being positioned and shaped in such a way that, as the bolt moves from the advanced, closed position to the retraced, open position, first the protrusion is engaged by the first cam and then the hollow is engaged by the second cam.

12. The device of claim 11, further comprising elastic means acting on the bolt in such a way as to keep the bolt in the advanced, closed position.

13. The device of claim 12, wherein the elastic means consist of a helical spring that presses against the shoulder of the bolt on the side opposite the arms and is positioned between the shoulder and an abutment forming part of the rolling block.

14. The device according to claim 12, further comprising a limit block that defines an end-of-stroke zero position of said key, and a spring acting between an aim of said key and said rolling block to allow said key to reach said zero position when said bolt is in said advanced closed position.

15. The device of claim 11, wherein the key has a manual actuating lever that is aligned with the line of sight when the bolt is in the advanced, closed position.

16. An opening and closing device according to claim 11, comprised in a rolling block firearm.

* * * * *